US005475974A

United States Patent [19]

Mackey et al.

[11] Patent Number: 5,475,974

[45] Date of Patent: Dec. 19, 1995

[54] OPEN END SPINNING DEVICE

[75] Inventors: Robert D. Mackey; George C. Edwards, both of Greensboro, N.C.

[73] Assignee: Burckhardt America, Inc., Greensboro, N.C.

[21] Appl. No.: 327,036

[22] Filed: Oct. 21, 1994

Related U.S. Application Data

[63] Continuation of Ser. No. 932,973, Aug. 20, 1992.

[51] Int. Cl.[6] ..... D01H 4/40

[52] U.S. Cl. ..... 57/417

[58] Field of Search ..... 57/417, 404, 406, 57/414, 416

[56] References Cited

U.S. PATENT DOCUMENTS

| | | | |
|---|---|---|---|
| 3,336,742 | 8/1967 | Stary et al. | 57/417 |
| 3,481,128 | 12/1969 | Landwehrkamp et al. | 57/417 |
| 3,640,061 | 2/1972 | Landwehrkamp | 57/417 |
| 3,651,632 | 3/1972 | Shepherd | 57/417 |
| 3,789,597 | 2/1974 | Schon | 57/417 |
| 3,875,731 | 4/1975 | Khomyakov et al. | 57/417 |
| 3,965,661 | 6/1976 | Yoshida | 57/417 |
| 4,712,369 | 12/1987 | Vernon | 57/417 |

*Primary Examiner*—Joseph J. Hail, III

*Attorney, Agent, or Firm*—Rhodes Coats & Bennett

[57] ABSTRACT

At least one circular ridge, which projects upwardly beyond the surface of the navel of the thread delivery device, is placed in the path of yarn being removed from the peripheral wall of the spinning chamber and delivered to the throat of the navel. The ridge has a height of at least. 003" and is radially so located in proximity to the edge of the navel that the yarn being formed and lifted from the wall of the spinning chamber first engages the navel at the ridge. The result of the engagement of the yarn with the ridge is that the twist is reduced and a higher break strength is achieved with a reduction in imperfections.

14 Claims, 4 Drawing Sheets

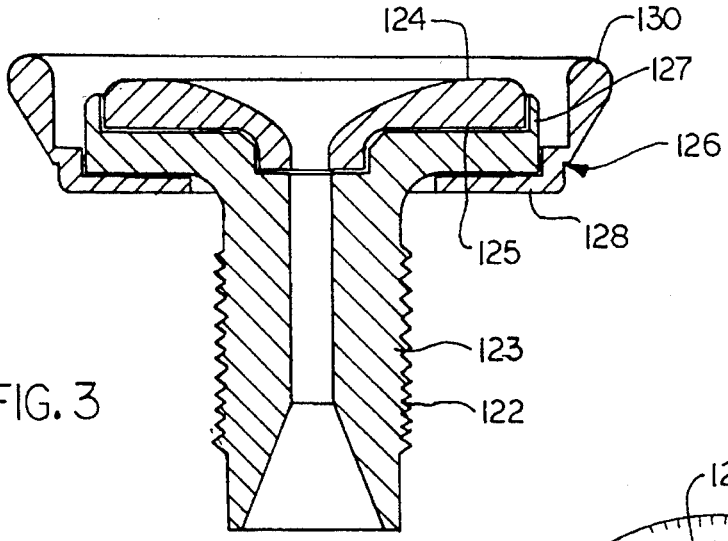
FIG. 3
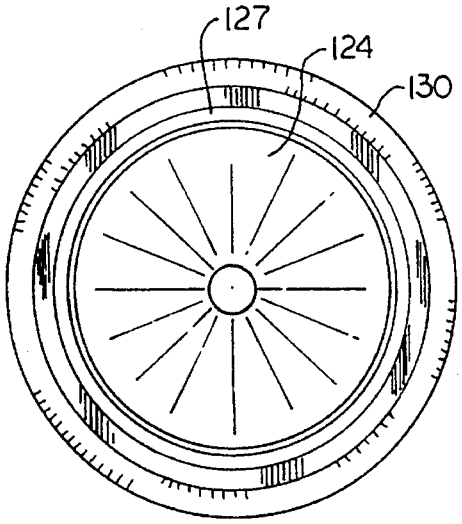
FIG. 4
FIG. 5
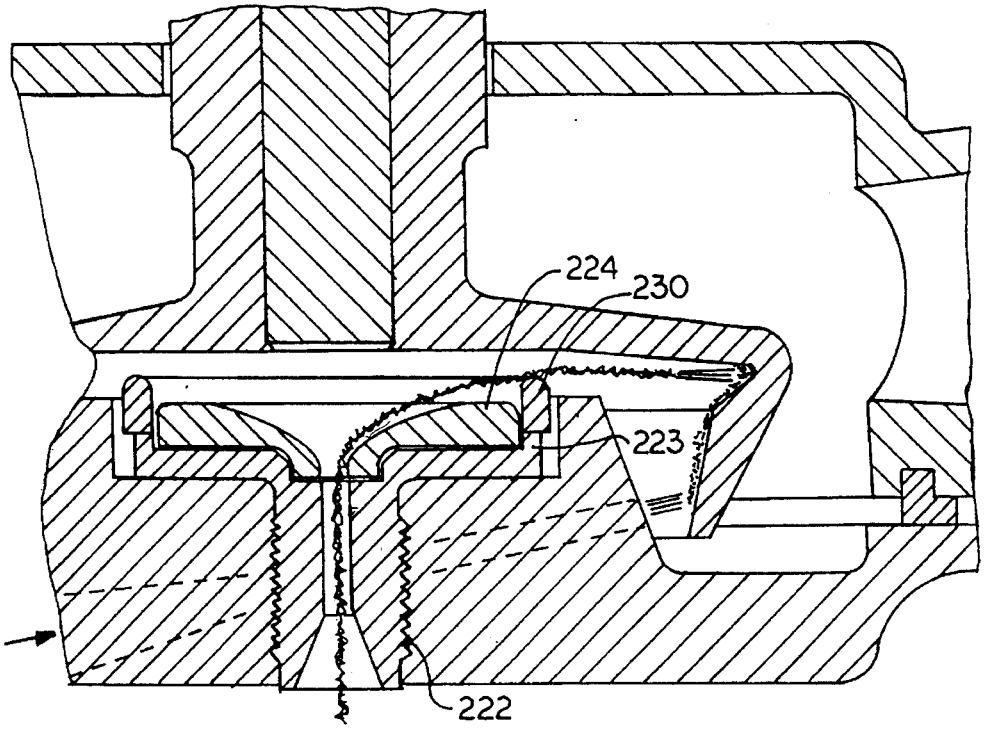

OPEN END SPINNING DEVICE

This application is a continuation of application Ser. No. 07/932,973, filed Aug. 20, 1992.

BACKGROUND AND SUMMARY OF THE INVENTION

The present invention is directed to open-end spinning, and more particularly, to an improvement in the configuration of the navel assembly over which the yarn passes as it is lifted from the wall of the spinning chamber and delivered to the navel throat.

Open-end spinning is a fiber preparation technique which originated in Europe and has received wide-spread acceptance in the last 25–30 years. Open-end spinning is a distinctly faster operation than other yarn preparation techniques such as "ring" spinning; however, it has several limitations including a relatively high twist and a relatively low break strength. Also, open-end spinning techniques generally do not result in a yarn having a soft hand, because of the yarn structure itself, which includes an inner parallel sheath of fibers and outer non-parallel fibers and wrapper fibers. The non-parallel fibers impart a harsh hand to the yarn. In the case of knitted and woven apparel goods, a soft hand is often preferred. As a result, yarns intended for certain knitted and woven apparel fabrics have not achieved wide-spread acceptance from open-end spinning systems.

For these and other reasons, it has been previously attempted to obtain a softer hand, and eliminate ends down situations by introducing one or more obstacles in the path of the yarn after it leaves the wall of the spinning rotor and enters the throat of the delivery tube. At such times, the spinning rotor causes the yarn to rotate around the inner periphery of the outlet or delivery tube as it passes therethrough engaging such obstacles as it rotates. This results in some surface treatment of the yarn. Such approaches are illustrated in U.S. Pat. Nos 4,258 541 to Le Chatelier et al; 4,011,712 to Egbers et al; and 4,516,397 to Raasch et al. Another approach which introduces a plurality of elongated ceramic rods in the inside wall of the delivery tube is illustrated and described in U.S. Pat. No. 4,712,369 to Vernon. Other approaches have provided one or more spiral obstacles or on the surface of the navel to provide a twist blocking element. These approaches are illustrated in the U.S. Pat. Nos. 4,702,069 to Maximov et al. and 4,665,687 to Ott et al.

While such approaches have achieved a certain level of success, other areas for improvement have remained unaddressed. First of all, the distance between the point at which the yarn first engages the navel or take-up device which creates false twist and the point at which the yarn is lifted from the wall of the spinning chamber (known as the "twist zone") has been relatively long, which has been a deterrent in achieving higher speeds. Long twist zones require a higher twist to successfully peel the yarn off the wall of the spinning chamber. The higher twist is not conducive to a softer hand. Further, the longer twist zone has been a hindrance to improved yarn evenness, imperfection levels, and break strength.

With these limitations in mind, the present invention is an attempt to provide a superior yarn at increased production levels by shortening the aforedescribed twist forming zone. In general, the twist forming zone is shortened by introducing a circular ridge or projection in or adjacent to the surface of the navel member at or adjacent the periphery thereof. In one approach, one or more circular ridges are attached to the peripheral rim of the navel support member. In a second approach, the projection is a separate outer ring which includes an annular rim that extends above the surface of the navel member. By the introduction of such ridges or projections, the twist forming zone is shortened considerably (on the order of 10–30%). The navel member, as used herein, is defined as the ceramic or stainless steel member generally supported by a support housing or navel body mounted in the rotor faceplate. The yarn initially passes over the navel member as it leaves the yarn collection surface or wall of the rotor on its way to the yarn delivery tube and/or take-up mechanism.

In general then, the present invention is directed to an improved navel member or assembly for open-end spinning devices of the type having a driven spinning chamber with the navel mounted coaxially therein and having a curvilinear inner surface. The navel assembly is improved by providing at least one circular projection on or adjacent the surface of the navel itself which projection extends upwardly from the surface thereof. The circular projection(s) has a height of at least 0.003" and is located in such proximity to the edge of the navel that the yarn being formed and lifted from the wall of the spinning chamber first engages the aforesaid projection, rather than the surface of the navel member. This then assists the false twist in reaching the wall of the spinning chamber.

More specific parameters to be considered are the variations in height of the impediment or ridge, the material from which the ridge is formed, the placement of the ridge, and the like which have been considered and are described hereinbelow. However, the primary or central feature of the invention is the existence of the circular ridge placed concentrically about the longitudinal axis of the delivery tube at or adjacent to the periphery of the navel member.

It has been found that navel members formed in accordance with the present invention result in improved rotor speeds on the order of 8–10%; increased production on the order of 20% in the case of polyester/cotton blends; a decrease in the twist multiple utilized; improved evenness; improved imperfection levels; and improved break strength. Also, the shortened twist forming zone which provides for the lower twist results in a softer or better hand in the yarn and requires less twist to peel the yarn off the wall of the spinning chamber in the yarn formation zone. The resulting yarn has less shedding and less outer wrapper fibers.

It is therefore an object of the present invention to provide a unique and improved construction for the navel assembly of open-end spinning frames.

It is another object of the present invention to provide a navel member of the type described which results in a softer hand and a higher quality thread output.

Another object of the present invention is to provide a navel member of the type described which provides for higher processing speeds without attendant problems.

Other objects and a fuller understanding of the invention will become apparent from reading the following detailed description of the preferred embodiment along with the accompanying drawings in which:

FIG. 3 is an enlarged sectional view of the navel assembly of the present invention in accordance with a first embodiment thereof;

FIG. 4 is an end view of the navel member of FIG. 3;

FIG. 5 is a sectional view of an open-end spinning rotor having a thread delivery device mounted therein in accordance with a first alternative embodiment of the present invention;

DETAILED DESCRIPTION OF A PREFERRED EMBODIMENT

Figure 1:
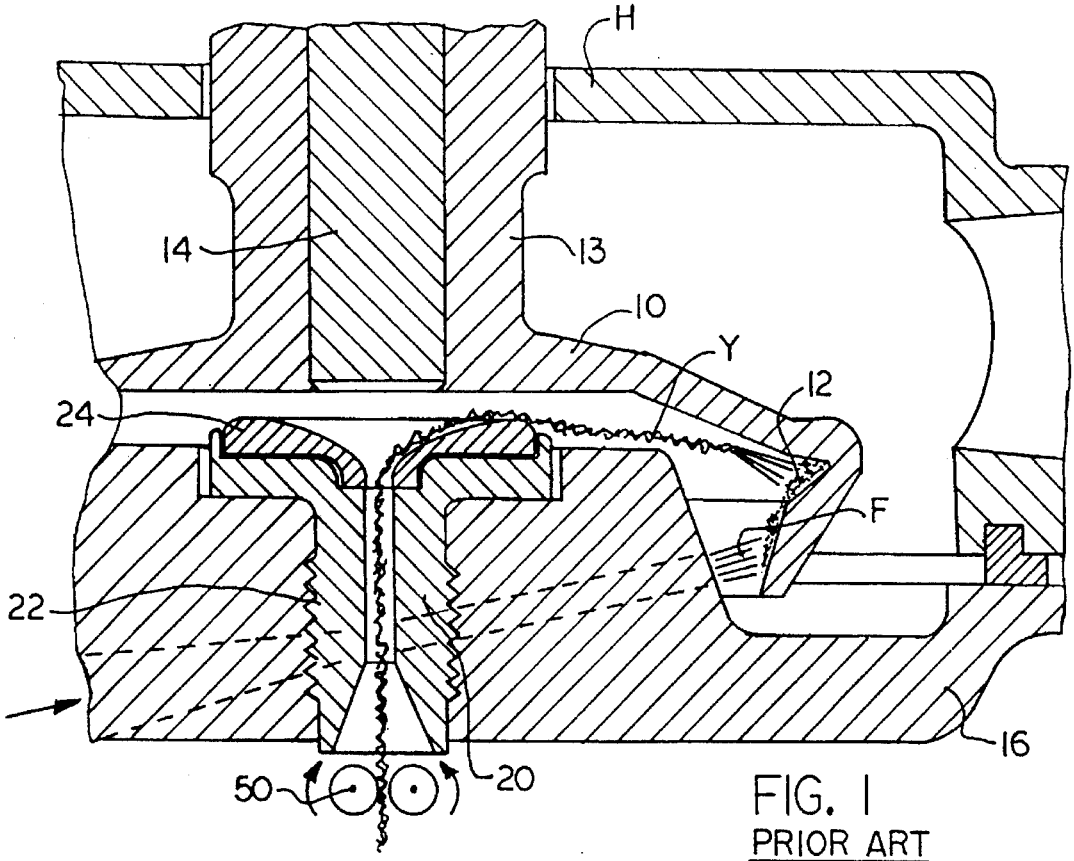
FIG. 1 PRIOR ART
FIG. 1 is a sectional view of an open-end spinning rotor having a thread delivery device in accordance with conventional construction.

Turning now to the drawings, there is illustrated a thread delivery device 20 inserted in the spinning rotor of an open-end spinning machine illustrative of the type with which the present invention is intended for use. The open-end spinning device of FIG. 1 is of a generally conventional design which includes a spinning rotor 10 having a fiber collecting groove 12 in which the fibers are initially deposited. The rotor hub 13 is turned by a drive shaft 14 at very high speeds, e.g., 60,000 rpm and greater. The fibers F form a yarn Y which is pulled through the thread delivery device 20 by a take-up mechanism 50. The housing H of rotor 10 is generally open on the side opposite the drive shaft 14, and is covered by a cover or faceplate 16 in which the thread delivery device or navel assembly 20 is mounted. The thread delivery device or navel member 20 is illustrated in FIG. 1 as an assembly with a support housing or navel body 22 which carries a ceramic cap or disc 24.

So arranged, as the yarn Y is pulled from the groove 12 of the spinning rotor 10, the yarn passes over the ceramic portion of the navel assembly 20 and is drawn therethrough by the take-up mechanism 50. As a result, the false twist induced on yarn Y extends essentially from the surface of the ceramic cap first contacted by the yarn back to the groove 12 in the rotor member 10. This is referred to as the "twist zone". The longer the twist zone, the higher the twist necessary to successfully peel the yarn from the wall of the spinning chamber. Further, longer twist zones have shown to be a hindrance to improved yarn evenness, imperfection levels, and break strength at a given set of spinning conditions.

Figure 2:
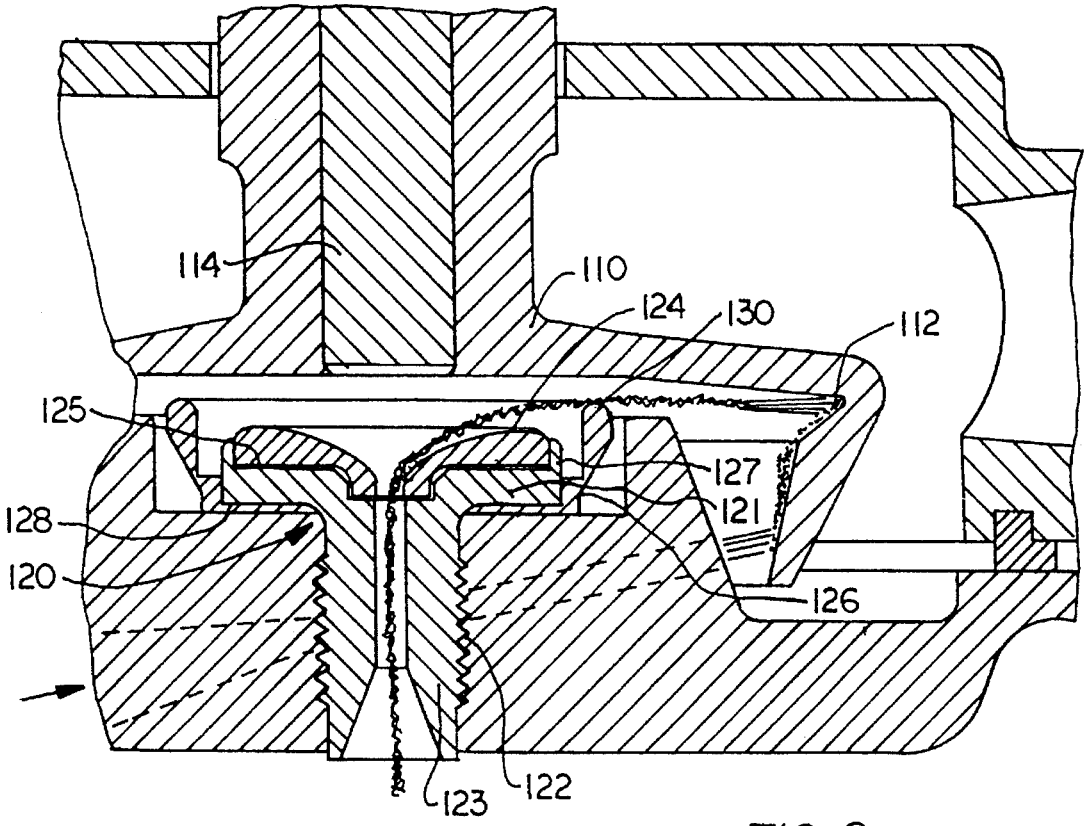
FIG. 2 is a sectional view of an open-end spinning rotor having a thread delivery device mounted therein in accordance with the present invention.

As illustrated in FIGS. 2–4, and in order to accomplish the goals of the present inventions, there is illustrated a first embodiment of the present invention in which there is introduced an upraised impediment in the yarn path at or adjacent the periphery of the navel assembly. In FIG. 2, the spinning rotor 110 is very similar to the spinning devices of conventional design and includes a fiber collecting groove 112. Again, the housing of rotor 110 is generally open on the side opposite the drive shaft 114, and is covered by a faceplate 116 containing navel assembly 120. The navel body 122 includes a tubular portion 123 through which the yarn Y passes on its way to the take-up mechanism. An annular portion 121 extends outwardly from the upstream end of tubular portion 123 and includes a peripheral lip 127. The annular portion 121 and lip 127 form a seat 125 for the ceramic cap 124. This navel structure is generally similar to the navel assembly of FIG. 1.

However, there is a significant difference in the navel assembly 120 of FIGS. 2–4. In the FIG. 2 device, the navel assembly 120, which is formed of the navel body 122 and the ceramic cap 124, is provided with an additional outer ring 126, hereinafter referred to as a faceplate ring. The outer ring includes an annular base portion 128 and a peripheral rim 130 that extends upwardly from a point adjacent the periphery thereof. The uppermost extent of annular rim 130 is approximately 0.010" above the level of the ceramic member 124 and provides a circular ridge or projection in the path of the yarn Y as it leaves the fiber collecting groove 112. It should be realized that the ridge 130 is circular and extends entirely around the periphery of the navel assembly 120. It should be realized that one or more small radial grooves could be placed in ring 130 about the periphery thereof to provide an interruption in the constant force required to remove the yarn from the collecting groove and thus improve yarn stability. Thus, the yarn end Y cannot enter the throat of the navel from any direction without passing over the ridge 130. The twist zone is thereby shortened to extend substantially from the projection 130 to the yarn collecting rim 112.

Figure 6:
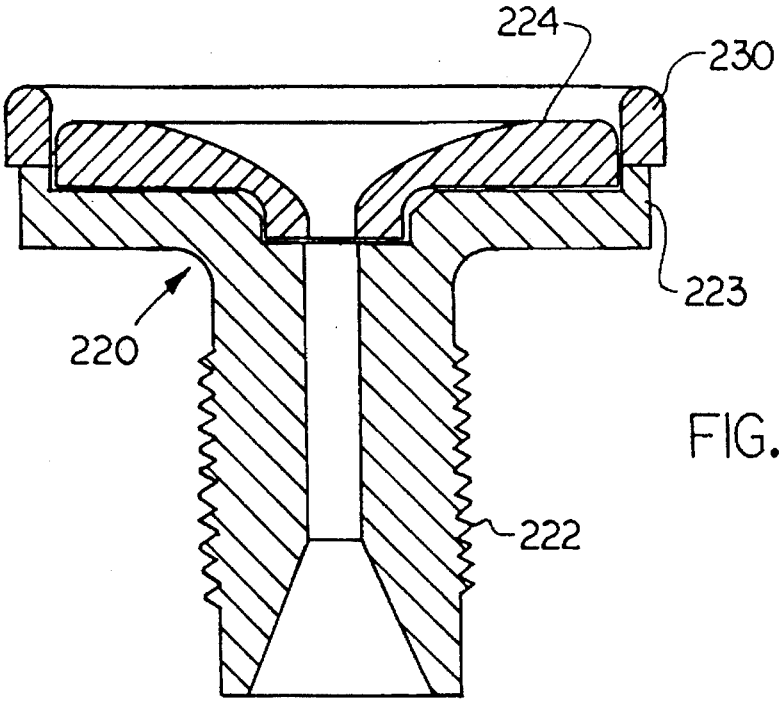
FIG. 6 is an enlarged sectional view of the alternate embodiment of FIG. 5.
Figure 7:
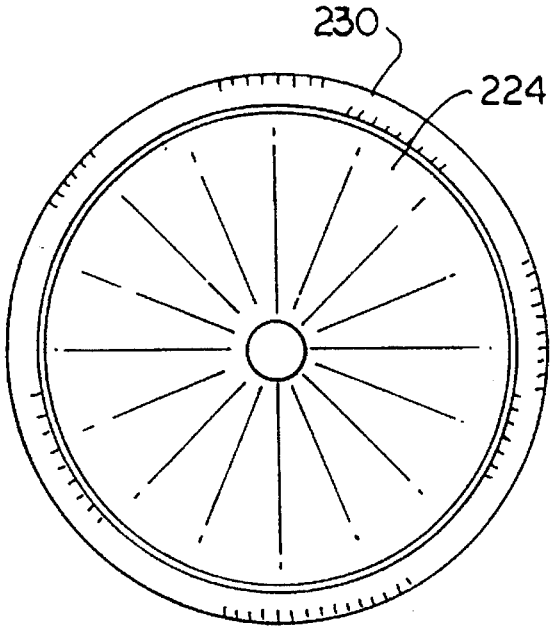
FIG. 7 is an end view of the navel member of FIG. 5.

In the embodiment illustrated in FIGS. 5–7, the navel assembly 220 again includes a similarly shaped navel body 222 and ceramic cap 224. In this embodiment, however, the ridge or projection 230 is a ring-shaped member substantially of the same radius as the peripheral rim 223 of the navel body. The ring 230 is secured to the rim 223 as by adhesive or in any other suitable manner.

Figure 9:
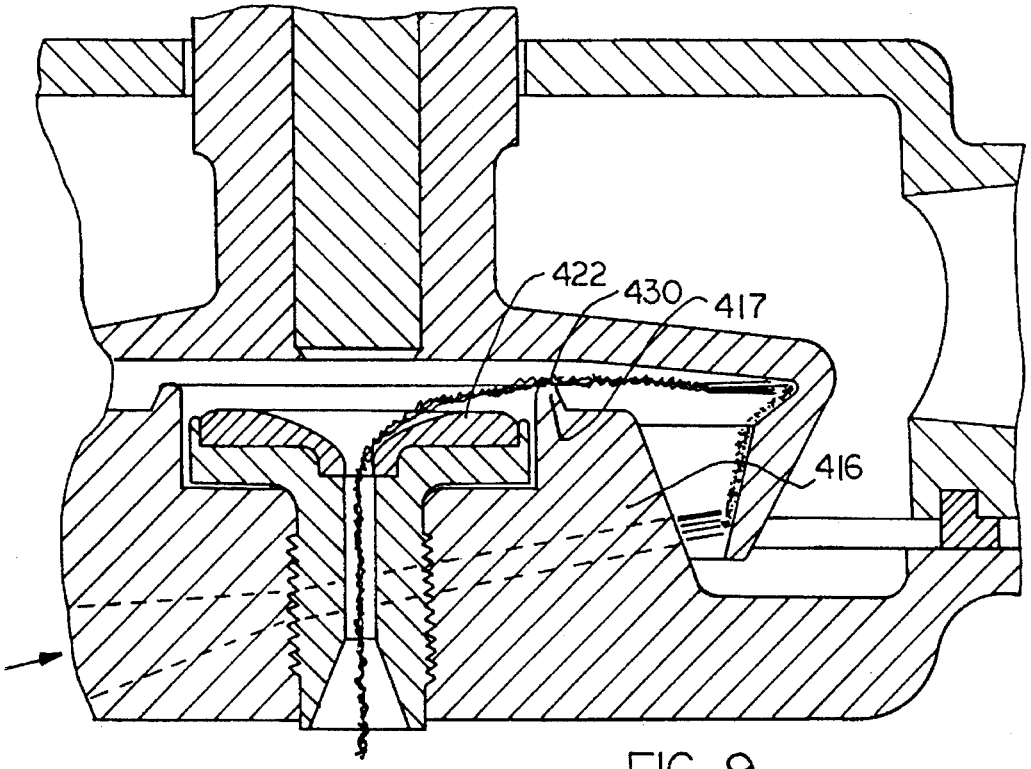
FIG. 9 is a sectional view similar to FIGS. 2, 5 and 8, except showing a third alternative embodiment of the invention.
Figure 8:
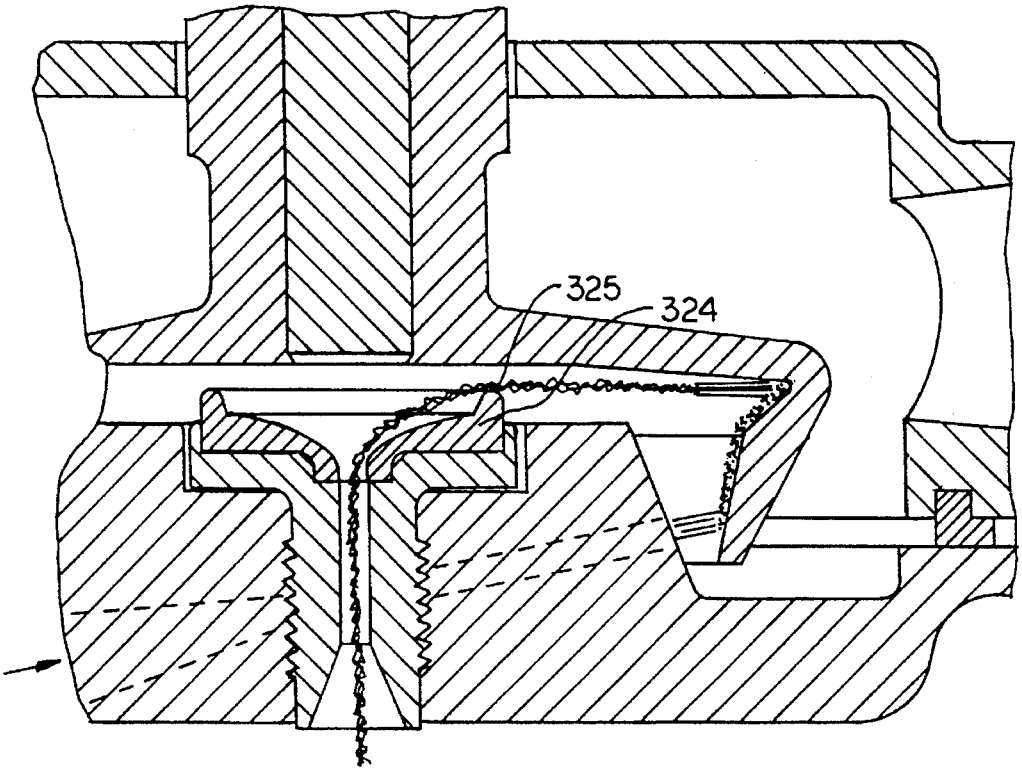
FIG. 8 is a sectional view similar to FIGS. 2 and 5, except showing a second alternative embodiment of the invention.

Alternatively, as shown in FIG. 8, the objects of the present invention could be met by molding a circular ridge 325 in the surface of the ceramic cap 324 at or adjacent the periphery thereof. As shown in FIG. 9, the results of the present invention could also be achieved by molding circular ridge 430 in the upstanding wall 417 of faceplate 416 adjacent the periphery of navel 422. It has been found that the ridge 130, 230, 325, 430 produces the best results if it is positioned approximately 0,010" above the surface of the ceramic cap 124, 224, 324, 422. However, it is believed that some variance from this dimension can occur, and preferably the height of the projection 130, 230 above the surface of the ceramic cap 124, 224, 324, 422 should be in the range of 0,003 and 0.020". It is not believed that the material from which projection 130, 230 is formed is critical, however, steel has been used successfully in tests, with the steel being either smooth or sandblasted.

Comparative testing has been conducted to show the effectiveness of the approach of the present invention, versus standard approaches. Before discussing the tests specifically, it is necessary to discuss the meaning and effect of several parameters:

a. Break strength, sometimes referred to as "skein break factor", is the force in pounds required to break a 120 yard skein of the yarn being tested (expressed as pounds required to break the skein multiplied by the actual English cotton count of yarn being broken), the higher the number, the stronger the yarn.

b. CV is a measure of yarn evenness and defined as the coefficient of variation of the mass of 10 mm increments of yarn measured over 1000 yards of yarn. The smaller the value, the better.

c. Neps are defined as 1 mm increments of yarn that are at least 200% greater than the mean mass of the measured yarn. The smaller the value, the better.

d. Thin places are defined as 10 mm increments of yarn that are 50% smaller than the mean mass of the measured yarn. The smaller the value, the better.

e. Thick places are defined as 10 mm increments of yarn that are 50% larger than the mean mass of the measured yarn. The smaller the value, the better.

A series of tests were conducted on three types of navels, i.e., standard navels, navels with added smooth faceplate ring (FIG. 3), and navels with sandblasted faceplate ring (FIG. 3 with sandblasted surface). The yarn tested was Ne 28/1 50/50 polyester/cotton. The rotor speed was 82,500 rpm and the take-up speed was 127 meters/minute. The results of two such series of tests are set forth hereinbelow.

TABLE 1

| | Standard Navel | Navel with Smooth Faceplate Ring | Navel with Sandblasted Faceplate Ring |
|---|---|---|---|
| Break Factor | 1672 | 1732 | 1623 |
| CV | 16.15 | 15.36 | 14.89 |
| Thins | 59 | 42 | 20 |
| Thicks | 208 | 123 | 98 |
| Neps | 330 | 147 | 110 |

TABLE 2

| | Standard Navel | Navel with Smooth Faceplate Ring |
|---|---|---|
| Break Factor | 1571 | 1782 |
| CV | 15.81 | 15.37 |
| Thins | 52 | 50 |
| Thicks | 164 | 97 |
| Neps | 557 | 334 |

As is evident at such higher speeds and reduced twists, navels having the faceplate rings produce stronger, more even yarns than standard navels. The yarns produced on the smooth faceplate rings were much stronger, however, the yarns produced on the sandblasted faceplate rings were somewhat more even.

Other tests have shown that good results are also obtained with the navel ring approach of FIGS. 5–7. The modifications have also been tested at speeds up to over 100,000 rpm, and on other yarns such as 100% cotton. In each case, the addition of the projection in the path of the yarn leaving the rim of the spinning rotor have been superior.

While a preferred embodiment of the invention has been described in detail hereinabove, it is apparent that various changes and modifications might be made without departing from the scope of the invention as set forth in the accompanying claims:

What is claimed is:

1. A navel member for open end spinning devices having a driven spinning chamber and a relatively stationary faceplate, said navel member having a curvilinear inner surface and comprising a tubular body portion having an upstream end and an annular portion extending outwardly from the upstream end thereof, said annular portion including a peripheral lip forming with said annular portion a seat for a ceramic cap mounted therein over which a yarn passes, wherein the improvement comprises at least one outer ring having a peripheral rim with an arcuate upper surface extending upwardly above the inner surface of said navel member in the path of said yarn, said outer ring separate from said annular portion and having an annular base portion interposed between said annular portion of said navel member and said faceplate and held in position thereby, said peripheral rim being located in such proximity to the periphery of said navel member that the yarn being formed and lifted from the wall of said spinning chamber engages said peripheral rim prior to engaging the surface of the navel member, and thereby limits the length of surface contact between the yarn and the inner surface of the navel, whereby the resulting yarn is produced at a lower twist level and a higher break strength is achieved.

2. The navel member according to claim 1 wherein said peripheral rim extends above the surface of said ceramic cap a distance in the range of 0.003 inch and 0.020 inch.

3. The navel member according to claim 1 wherein said peripheral rim extends above the surface of said ceramic cap approximately 0.010 inch.

4. The navel member according to claim 1 wherein said tubular body portion includes a threaded outer surface adapted to engage a threaded bore formed in said faceplate, and whereby said annular base portion is secured between said annular portion and said faceplate by screwing said tubular body portion into said threaded bore.

5. A navel member for open end spinning devices having a driven spinning chamber and a relatively stationary faceplate, said face-plate having a threaded bore formed therein, said navel member comprising a tubular body portion having an upstream end, a threaded outer surface adapted to engage said threaded bore, and an annular portion extending outwardly from the upstream end thereof, said annular portion including a peripheral rim forming with said annular portion a seat for a ceramic cap mounted therein over which a yarn passes, said ceramic cap having a curvilinear inner surface extending from said threaded bore substantially across said annular portion, wherein the improvement comprises a yarn engaging ring having substantially the same radius as said peripheral rim and being mounted by adhesive on said peripheral rim, said ring having an arcuate upper surface extending upwardly above the inner surface of said navel member in the path of said yarn, said outer ring being located in such proximity to the periphery of said navel member that the yarn being formed and lifted from the wall of said spinning chamber engages said outer ring prior to engaging the surface of the navel member and is lifted from the outer portion thereof, whereby said yarn engaging ring limits the length of surface contact between the yarn and the inner surface of the navel, and the resulting yarn is produced at a lower twist level and a higher break strength is achieved.

6. The navel member according to claim 5 wherein said outer ring extends above the surface of said ceramic cap a distance in the range of 0.003 inch and 0.020 inch.

7. The navel member according to claim 5 wherein said outer ring extends above the surface of said ceramic cap approximately 0.010 inch.

8. A yarn engagement ring for use in conjunction with a navel member for open end spinning devices having a driven spinning chamber and a relatively stationary face place, the navel member having a curvilinear inner surface and comprising a tubular body portion having an upstream end and an annular portion extending outwardly from the upstream end thereof, the annular portion including a peripheral lip forming with the annular portion a seat for a ceramic cap mounted therein over which a yarn passes, said yarn engagement ring comprising: at least one outer ring having a peripheral rim with an arcuate upper surface extending upwardly above the inner surface of the navel member in the path of the yarn, said outer ring separate from the annular portion and having an annular base portion interposed between the annular portion of the navel member and the faceplate and held in position thereby, said peripheral rim being located in such proximity to the periphery of the navel member that the yarn being formed and lifted from the wall of the spinning chamber engages said peripheral rim prior to engaging the surface of the navel member, and thereby limits the length of surface contact between the yarn and the inner surface of the navel, whereby the resulting yarn is produced at a lower twist level and a higher break strength is achieved.

9. The yarn engagement ring according to claim 8 wherein said peripheral rim extends above the surface of the ceramic cap a distance in the range of 0.003 inch and 0.020 inch.

10. The yarn engagement ring according to claim 8 wherein said peripheral rim extends above the surface of the ceramic cap approximately 0.010 inch.

11. The yarn engagement ring according to claim 8 wherein the tubular body portion includes a threaded outer surface adapted to engage a threaded bore formed in the faceplate, and whereby said annular base portion is secured between the annular portion of the navel and the faceplate by screwing the tubular body portion into the threaded bore.

12. A navel member for open end spinning devices having a driven spinning chamber and a relatively stationary faceplate, the faceplate having a threaded bore formed therein, said navel member comprising:

(a) a tubular body portion having an upstream end, a threaded outer surface adapted to engage said threaded bore, an annular portion extending outwardly from the upstream end thereof, and a ceramic cap seated on said annular portion;

(b) said annular portion including a peripheral rim forming with said annular portion a seat for said ceramic cap mounted therein over which said yarn passes;

(c) said ceramic cap having a curvilinear inner surface extending from said threaded bore substantially across said annular portion;

(d) at least one outer ring having substantially the same radius as said peripheral rim and being mounted by adhesive on said peripheral rim, said outer ring having an arcuate upper surface extending upwardly above the inner surface of said navel member in the path of said yarn;

(e) wherein said outer ring is located in such proximity to the periphery of said navel member that the yarn being formed and lifted from the wall of said spinning chamber engages said outer ring prior to engaging the surface of the navel member and is lifted from the outer portion thereof, whereby said yarn engaging ring limits the length of surface contact between the yarn and the inner surface of the navel, and the resulting yarn is produced at a lower twist level and a higher break strength is achieved.

13. The navel member according to claim 12 wherein said outer ring extends above the surface of said ceramic cap a distance in the range of 0.003 inch and 0.020 inch.

14. The navel member according to claim 12 wherein said outer ring extends above the surface of said ceramic cap approximately 0.010 inch.

* * * * *